US006686702B1

(12) United States Patent
Holmes

(10) Patent No.: US 6,686,702 B1
(45) Date of Patent: Feb. 3, 2004

(54) TRANSFORMERLESS XENON POWER SUPPLY

(76) Inventor: Fred H. Holmes, Rte. 3, Box 79, Cleveland, OK (US) 74020

( * ) Notice: Subject to any disclaimer, the term of this patent is extended or adjusted under 35 U.S.C. 154(b) by 0 days.

(21) Appl. No.: 09/990,774

(22) Filed: Nov. 14, 2001

Related U.S. Application Data

(60) Provisional application No. 60/262,453, filed on Jan. 18, 2001.

(51) Int. Cl.[7] ..... H05B 37/02

(52) U.S. Cl. ..... 315/247; 315/219; 315/307

(58) Field of Search ..... 315/219, 307, 315/209 R, 247

(56) References Cited

U.S. PATENT DOCUMENTS 5,731,665 A * 3/1998 Pruett ..... 315/247

6,181,077 B1 1/2001 Greenland

* cited by examiner

*Primary Examiner*—David Vu
(74) *Attorney, Agent, or Firm*—Fellers, Snider, Blankenship, Bailey & Tippens, P.C.

(57) ABSTRACT

A transformerless, high power xenon power supply for providing a DC voltage to a high wattage xenon bulb. The power supply includes: a first DC power supply which accepts incoming AC power and provides a first DC output, the first DC power supply having a first capacitor for filtering the voltage at the first DC output; a current path having an inductor, a controllable switch for controlling the electrical current flowing through the inductor, and a second capacitor for filtering the voltage at an output of the current path; and a pulse width modulator having an output in communication with the controllable switch. The output of the current path is not electrically isolated from the incoming AC power. The inventive power supply may offer significant reductions in size, weight, and cost over designs having a transformer.

4 Claims, 7 Drawing Sheets

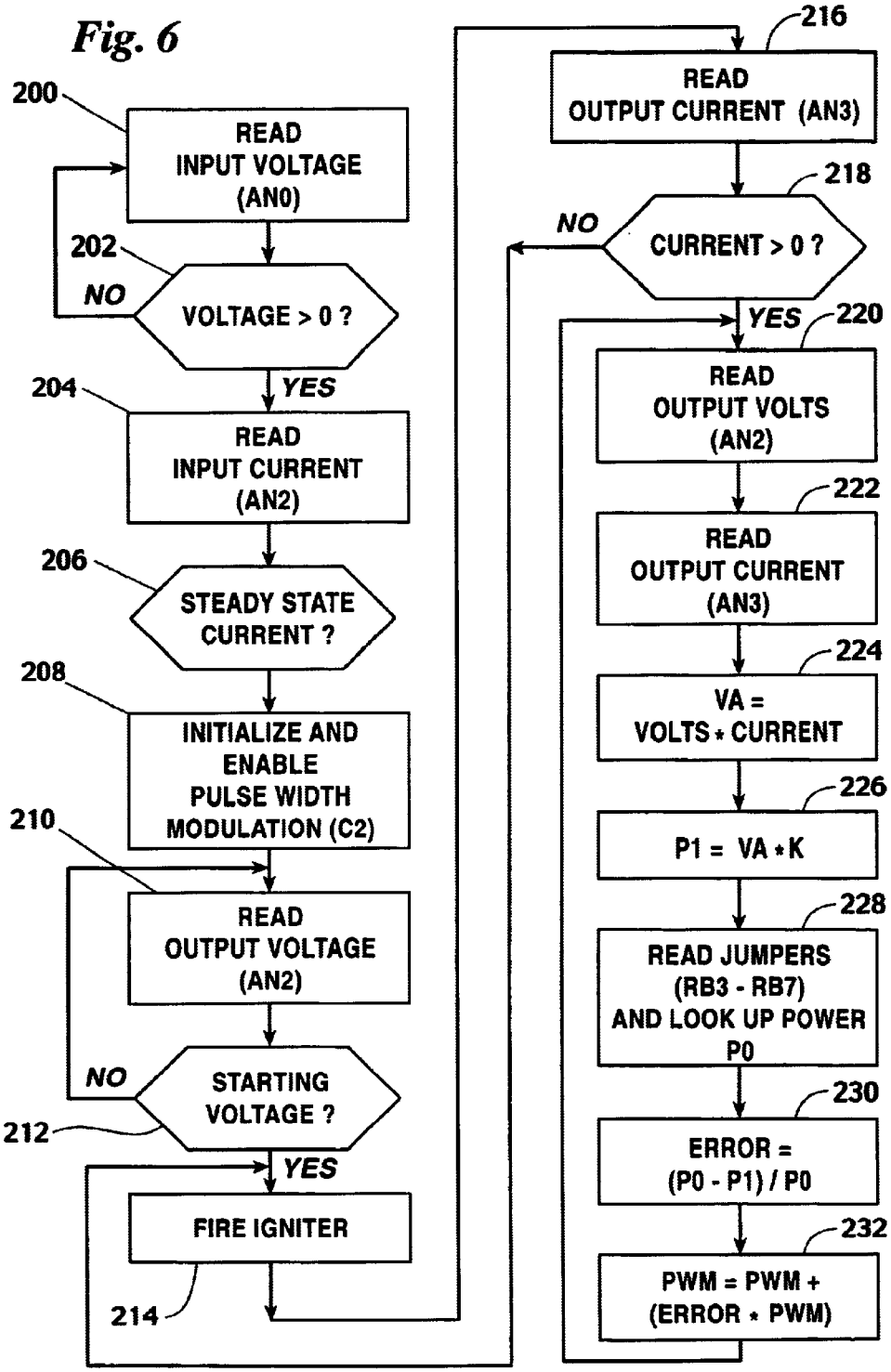
Fig. 6
200
READ INPUT VOLTAGE (AN0)
202
NO
VOLTAGE > 0 ?
YES
204
READ INPUT CURRENT (AN2)
206
STEADY STATE CURRENT ?
208
INITIALIZE AND ENABLE PULSE WIDTH MODULATION (C2)
210
READ OUTPUT VOLTAGE (AN2)
NO
STARTING VOLTAGE ?
212
YES
FIRE IGNITER
214
216
READ OUTPUT CURRENT (AN3)
218
NO
CURRENT > 0 ?
YES
220
READ OUTPUT VOLTS (AN2)
222
READ OUTPUT CURRENT (AN3)
224
VA = VOLTS * CURRENT
226
P1 = VA * K
228
READ JUMPERS (RB3 - RB7) AND LOOK UP POWER P0
230
ERROR = (P0 - P1) / P0
232
PWM = PWM + (ERROR * PWM)

TRANSFORMERLESS XENON POWER SUPPLY

CROSS REFERENCE TO RELATED APPLICATION

This application claims priority from copending U.S. provisional patent application Serial No. 60/262,453, filed Jan. 18, 2001, the disclosure of which is incorporated herein by reference.

BACKGROUND OF THE INVENTION

1. Field of the Invention

The present invention relates to a power supply to provide electrical power to a xenon bulb. More particularly, but not by way of limitation, the present invention relates to a transformerless power supply for a xenon bulb which, in one embodiment, provides a constant programmable power to the bulb.

2. Background of the Invention

Continuous arc xenon bulbs provide bright, stable, daylight balanced light at power levels from a few watts up to tens of thousands of watts. Such bulbs are widely accepted in architectural, entertainment, and medical applications. Typically such bulbs require a moderate DC voltage (on the order of 18 to 150 volts) at a relatively high current for steady-state operation. In addition, a higher voltage is usually provided for starting (usually between 2 and 10 times the operating voltage) along with a very high voltage, short duration ignition pulse (on the order of several kilovolts for a period ranging from a few microseconds to a few milliseconds). This higher start-up voltage and the ignition pulse tend to complicate xenon power supply designs.

Presently, xenon power supplies may be logically divided into two distinct groups: a) those that operate at line frequency, otherwise known as magnetic ballasts; and b) those that operate at higher frequencies, commonly referred to as electronic power supplies. It should be noted that the terms "ballast" and "power supply" are often used interchangeably. Magnetic ballasts typically employee a transformer followed by a rectifier and filter capacitors to provide the steady-state electrical power, much like a conventional linear power supply. Magnetic ballasts rely on the inductance of the transformer, or a separate inductor in series with the transformer, to limit the current provided by the ballast. The inductance acts on the line frequency of the AC power supplied to the ballast leading to ballasts which are characteristically large and heavy compared to their electronic counterparts.

Electronic power supplies, on the other hand, typically rectify and filter the incoming electrical power. Solid state switches such as transistors, MOSFETs, IGBTs, or the like, are used to "chop" the resulting DC voltage at a relatively high frequency, typically somewhere between 10 kilohertz and 100 kilohertz. A transformer is then used to produce a lower voltage which is again rectified and filtered to provide a steady-state direct current output. The higher frequency provides substantial reductions in the size and weight of the transformer and efficient regulation of the output voltage may be easily achieved by varying the frequency at which switching occurs, the duty cycle provided at the switches, or both. While electronic power supplies are smaller and lighter than their magnetic counterparts, they are also more complex. In addition, electronic power supplies designed to power xenon bulbs above 3600 watts presently stretch the practical limits of the solid state switches employed, resulting in hot components and reduced life of the component parts. Presently, the selection of a particular solid state switch requires balancing switching frequency, and thus the size and weight of the reactive components, against power handling capability.

Thus, magnetic ballasts have dominated the high power xenon field. The term "high power" as used in conjunction with the present invention refers to xenon bulbs which are designed to consume more than about 2500 watts of electrical power. Practically speaking, short-arc xenon bulbs may presently be produced up to about 20,000 watts while long-arc xenon bulbs of at least 100,000 watts are presently available.

While magnetic ballasts perform satisfactorily in many applications, they are marginal for use in the entertainment industry for a number of reasons. For example, such ballasts often produce "ripple" at the line frequency or, perhaps, at twice the line frequency. In the United States, this results in 60 Hz or 120 Hz flicker. When a filmed scene is lighted with a xenon powered by such a ballast, "beating" between the motion picture frame rate and the flicker can result in flicker at a much lower, perceivable rate in the recorded images. In addition, flicker at any rate will totally preclude the use of frame rates higher than the flicker rate. Furthermore, magnetic ballasts designed for these power levels are often too heavy to be moved manually and therefore require undue time and labor for setup and tear down.

While high power electronic power supplies are available, the size and weight of such devices approaches that of magnetic ballasts. Presently, the most palatable solution for the entertainment industry is the ganging of lower power electronic power supplies to supply high power xenon bulbs. "Ganging" involves the parallel connection of two or more power supplies. To date, the ganging of lower power electronic power supplies has proven reasonably effective up to power levels of 10 kilowatts. Unfortunately, not all electronic power supplies are gangable and, of those that are gangable, load sharing among ganged power supplies is less than perfect. Therefore, it is common for one power supply in a ganged configuration to operate at substantially higher temperature than its co-power supplies, resulting in unreliable operation and premature failure of the over-worked supply. In addition, it has been observed that ganging power supplies may produce substantial ripple, and hence flicker, at rates which are much lower than the switching frequency of the power supplies, thus also raising concerns when used to light a motion picture scene.

Another problem which arises in the use of high power xenon bulbs is inconsistent bulb voltage. First, bulb operating voltage may vary significantly over the life of the bulb. Second, there are significant variations in bulb voltage from bulbs offered by different bulb manufacturers. Finally, bulb voltage varies significantly with the temperature of an individual bulb and, therefore, varies as the bulb heats during use. Neither magnetic ballasts or electronic power supplies presently handle such variations in bulb voltage appropriately. In virtually all instances, the bulb will be operated above or below rated power depending on whether the bulb operating voltage is above or below the voltage for which the power supply was designed. In many respects, an ignited xenon bulb resembles a zener diode, e.g., large changes in current flowing through the bulb result in relatively small changes in bulb voltage. Thus, proper regulation of bulb brightness requires the operation of the power supply in a "constant power" mode. Typically, presently available electronic power supplies tightly regulate either output voltage or output current, either of which results in inconsistent bulb brightness as the bulb voltage varies.

Additionally, prior art electronic power supplies have utilized a transformer to step down the "chopped" input voltage to a voltage closer to the bulb voltage. Thus used, the transformer may serve a number of purposes. For example: the output power to the bulb is isolated from the power line and from earth ground; the transformer may be included in the oscillator design which drives the solid state switches, as with a relaxation oscillator; the inductive nature of the transformer provides an upper limit on the electrical current; and the transformer provides a reduction in voltage, allowing the switches to operate at a higher duty cycle which improves the power supply's ability to resolve the output voltage. Unfortunately, the transformer is a large, heavy, and costly component of a high power xenon ballast.

A final consideration in the design of a high power xenon ballast is the apparent phase angle between the incoming voltage and incoming current, otherwise known as "power factor". Power factor is defined as the cosine of the phase angle between voltage and current in an AC system. Ideally any system connected to an AC power line will exhibit a power factor of one. Generally speaking, a power factor of less than one poses a problem for the utility company, rather than the user of the electrical power, resulting in increased line losses. However, many jurisdictions require electrical products to carry the mark of a recognized testing laboratory and typically the standards applied by such laboratories set limits on the power factor exhibited by electrical devices connected to AC power. Thus, a xenon power supply aimed at a global market will require power factor correction for compliance with such standards. While some xenon power supplies presently include power factor correction, none of these supplies take advantage of a power factor correction scheme which can reduce the size, weight, and cost of downstream components and actually facilitate a transformerless power supply.

It is thus an object of the present invention to provide a transformerless electronic power supply for a xenon bulb.

It is still a further object of the present invention to provide a power factor corrected electronic power supply for a xenon bulb.

It is yet a further object of the present invention to provide a transformerless, power factor corrected high power xenon power supply which weighs substantially less than presently available high power ballasts.

SUMMARY OF THE INVENTION

The present invention provides a microprocessor controlled, transformerless, high power xenon power supply which is power factor corrected as to the incoming line. The power factor correction provides a first stage of voltage regulation. A second stage, switching regulator, synchronized to the power factor correction, provides power regulation at a predetermined wattage, regardless of bulb voltage as long as bulb voltage remains within a prescribed range. Synchronization of the power factor correction and the second stage regulator allows a reduction in value, and therefore the size, of the filter capacitors required to reduce ripple to a particular level.

In a preferred embodiment, a programmable microcontroller monitors the output voltage and output current to derive output power. The microcontroller adjusts the duty cycle of a pulse width modulated output, which drives solid state switches of the second stage regulator, to maintain a substantially constant output power.

Preferably, the second stage regulator incorporates one or more current paths depending on the output power desired. Each current path comprises: a solid state switch, i.e. a transistor, MOSFET, IGBT, or the like; an inductor; and a capacitor. The number of current paths employed determines the maximum power output of the power supply. Thus, by way of example and not limitation, if a 4000 watt power supply employed a single current path, a 7000 watt power supply would employ two current paths, and a 10,000 watt power supply would employ three current paths. The individual elements of each current path are therefore no larger than required to attain the maximum output level for a given power supply wattage.

The power factor correction circuit employs a controller which monitors the input current and input voltage, and modulates an output to one or more solid state switches to shape the input current to match the input voltage at a phase angle near zero. Similar to the second stage regulator, the power factor correction provides one or more current paths, depending on the desired output power. Preferably each current path comprises: an inductor connected to a solid state switch in a boost configuration and a diode for summing the outputs of the various current paths into one or more capacitors.

In one preferred embodiment, the inventive high power xenon power supply includes an input to control dimming of the xenon bulb. In a dimming configuration, a maximum voltage (i.e., five volts DC) applied to the dimming input results in the power supply producing the maximum output power. Zero volts applied to the dimming input results in the power supply producing a minimum output power, typically 40% of the maximum power. A voltage in between the maximum and minimum voltages would result in an intermediate output power proportional to the level of the applied dimming voltage.

For starting, the capacitors of the second stage regulator are charged to a starting voltage, typically on the order of 150 volts. An ignition pulse is then triggered by the microcontroller through a conventional ignitor circuit, resulting in a high voltage pulse applied across the xenon bulb. Upon detecting current flow from the second stage regulator, indicating an ignited bulb, the microcontroller begins regulating the output at a predetermined level.

Further objects, features, and advantages of the present invention will be apparent to those skilled in the art upon examining the accompanying drawings and upon reading the following description of the preferred embodiments.

BRIEF DESCRIPTION OF THE DRAWINGS

FIG. 6 provides a flow chart of a computer program as used in the inventive high power xenon power supply.

DESCRIPTION OF THE PREFERRED EMBODIMENTS

Figure 1:
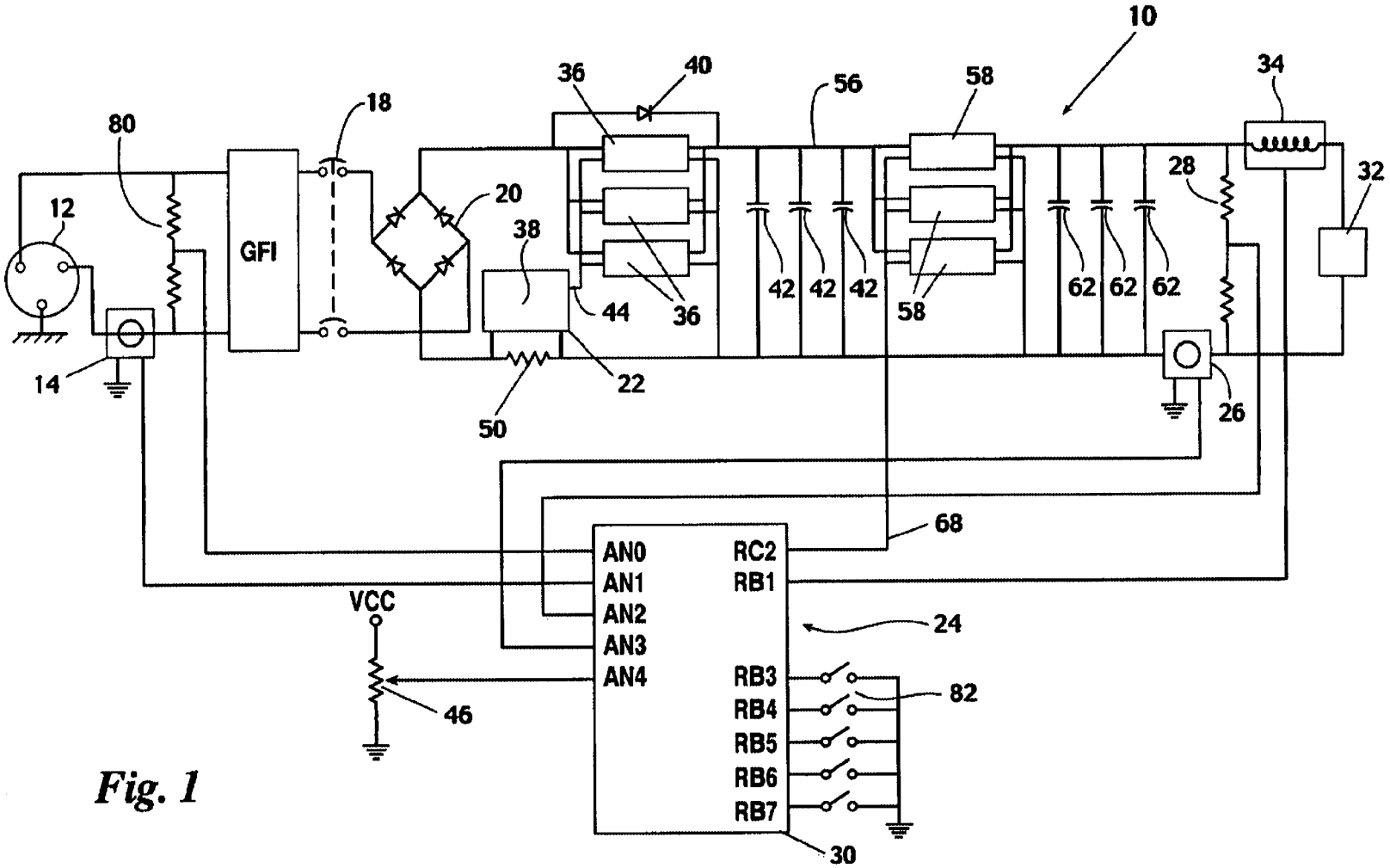
FIG. 1 provides a block diagram of the inventive transformerless high power xenon power supply.

As shown in FIG. 1 the inventive high power xenon power supply 10 preferably comprises: a power connector 12 for connection to a power source such as conventional alternating current provided by an electric utility company; a current sensor 14 for monitoring the incoming current; a ground fault interrupter 16 for disconnection of the power supply in the event of a current path to earth ground; circuit breaker 18 for protection against over current conditions; bridge rectifier 20 for conversion of the incoming AC power to DC power; power factor correction system 22 for sinusoidally shaping the incoming current to match the incoming voltage; second stage regulator 24 for selectively regulating the output at a predetermined voltage, current, or power as discussed herein below; output current sensor 26 for monitoring the electrical current flowing through the xenon bulb 32; voltage sensor 28 for monitoring the output voltage applied to the xenon bulb 32; microcontroller 30; and ignitor 34 for producing a high voltage ignition pulse. In addition, power supply 10 may be provided with a potentiometer 46, or electronic input means, for providing a dimming input.

The term "high power" as used herein refers to xenon bulbs intended to consume 2500 watts or more of electrical power and to power supplies for such bulbs. It should be noted that presently there are no commercially available xenon bulbs designed for continuous use above 10,000 watts. Thus, the description of the preferred embodiment is provided herein with regard to such commercially available bulbs. As will be apparent to those skilled in the art, the present invention could readily be modified to accommodate xenon bulbs far in excess of 100,000 Hz watts, should such bulbs become available, and it is the intention of the inventor that such modifications are within the scope of the present invention. It should also be noted that presently there are 100,000 Hz watt long-arc xenon bulbs produced in small quantities. While the voltage required to operate long-arc xenon bulbs is substantially different from that required for short-arc xenon bulbs, the inventive power supply is, nonetheless, adaptable for use with such bulbs.

Turning next to the ignitor 34, xenon ignitors are well known in the art and the ignitor 34 incorporated in the inventive power supply is a conventional, commercially available xenon ignitor. Such ignitors receive an input (typically on the order of 100 volts, or more) and generate an output pulse of several thousand volts. The ignitor is typically wired in series with the bulb and a power supply such that the voltage across an unignited bulb is the sum of the power supply voltage and the ignitor voltage. Upon the generation of the high voltage pulse from the ignitor, the xenon gas in the bulb ionizes and an electrical arc is started between the internal electrodes in the bulb. After ignition, the voltage produced by the second stage regulator 24 is then sufficient to sustain the arc.

Figure 2:
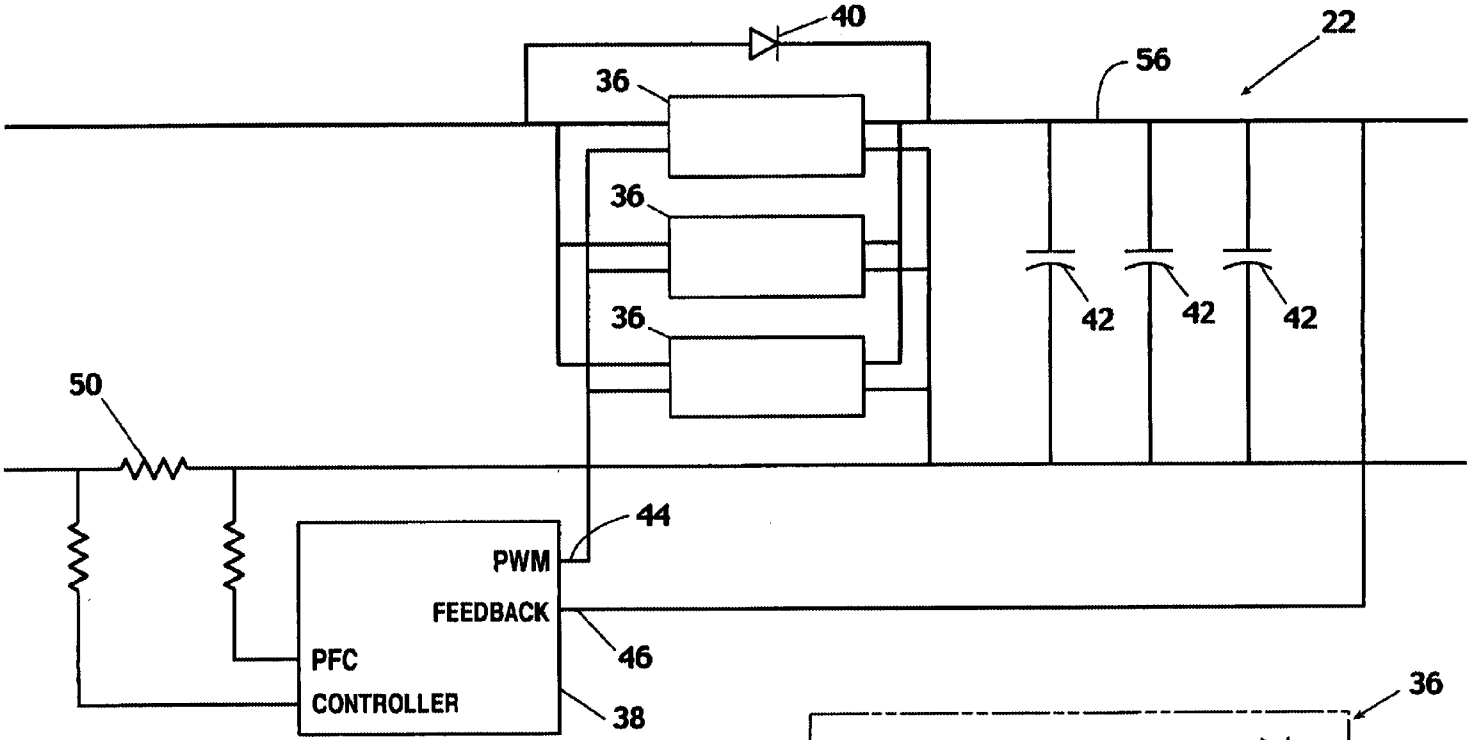
FIG. 2 provides a block diagram for a preferred power factor correction circuit as incorporated in the inventive xenon power supply.

Referring next to FIG. 2, preferably power factor correction circuit 22 comprises: one or more current paths 36; a power factor correction controller 38; bypass diode 40; and capacitors 42. Power factor correction schemes are well known in the art and the power factor correction scheme employed herein is similar to prior art schemes except as discussed hereinbelow. Power factor controllers are likewise well known in the art and typically are provided as a single integrated circuit. One such power factor controller is the UCC3817 BiCMOS power factor preregulator manufactured by Texas Instruments, Inc. of Dallas, Tex. The UCC3817 device is suitable for use in the inventive power factor correction circuit when used with support components as suggested by Texas Instruments, Inc. The use of the UCC3817 device in this manner is within the level of skill of one of ordinary skill in the art.

Figure 3:
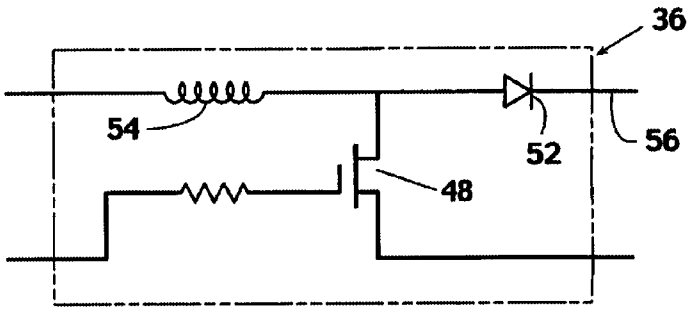
FIG. 3 provides a schematic diagram for a preferred current path of the power factor correction circuit.

Referring now to FIGS. 2 and 3, power factor controller 38 provides a pulse width modulated output 44 for driving boost switch 48. Preferably the switching frequency applied to solid state switch 48 is high (typically between 10 kilohertz and 100 kilohertz) relative to the power line frequency (typically 50 or 60 Hertz, depending on the country in which the device is used). Controller 38 varies the duty cycle of the waveform applied to switch 48 to shape the current flowing through current sensing resistor 50 such that the input current waveform matches the sinusoidal shape of the input voltage at approximately a zero degree phase angle between the two waveforms.

Bypass diode 40 charges capacitors 42 to substantially the peak of the incoming AC line voltage (minus a small voltage drop across bridge 20 and diode 40). As required to shape the current, controller 38 activates switch 48 thereby storing electrical energy in inductor 54. As appropriate, controller 38 deactivates switch 48. The energy stored in inductor 54 causes the voltage to rise at node 56 resulting in current flow through diode 52 and increasing the voltage stored in capacitors 42. The power factor controller 38 includes voltage feedback input 46 through which controller 38 compares the voltage at node 56 to an internal reference to likewise adjust the duty cycle of the output 44 to switch 48 such that the voltage at node 56 is regulated at approximately 350 volts.

As shown in FIG. 3, a power factor correction current path 36 preferably involves an inductor 54, a solid state switch 48 wired in a boost configuration, and a diode 52. By switching the current through the current path 36, controller 38 preferably causes capacitors 42 (FIG. 2) to be charged to a voltage greater than that of the incoming AC line. Solid state switch 48 is typically a transistor, a MOSFET, an IGBT, or the like. Presently with known solid state switch types there exists a tradeoff between current handling capability and the switching frequency at which the device may be switched. Thus, while individual devices are available which could switch the electrical current required for a high power xenon power supply above 4000 watts, such devices could only operate in the range of ten to twenty kilohertz. As the operating frequency is reduced, the physical size of the reactive components (i.e., inductors and capacitors) must be increased. Thus, while a single switch could be used, the size and weight of the reactive components becomes prohibitive for ballasts above 4000 watts. On the other hand, switches are available which work well at switching frequencies up to 100 kilohertz and provide adequate current for a 4000 watt power supply. Thus, multiple switches 48 could be employed to achieve higher power outputs while still maintaining a desirable switching frequency.

Figure 4:
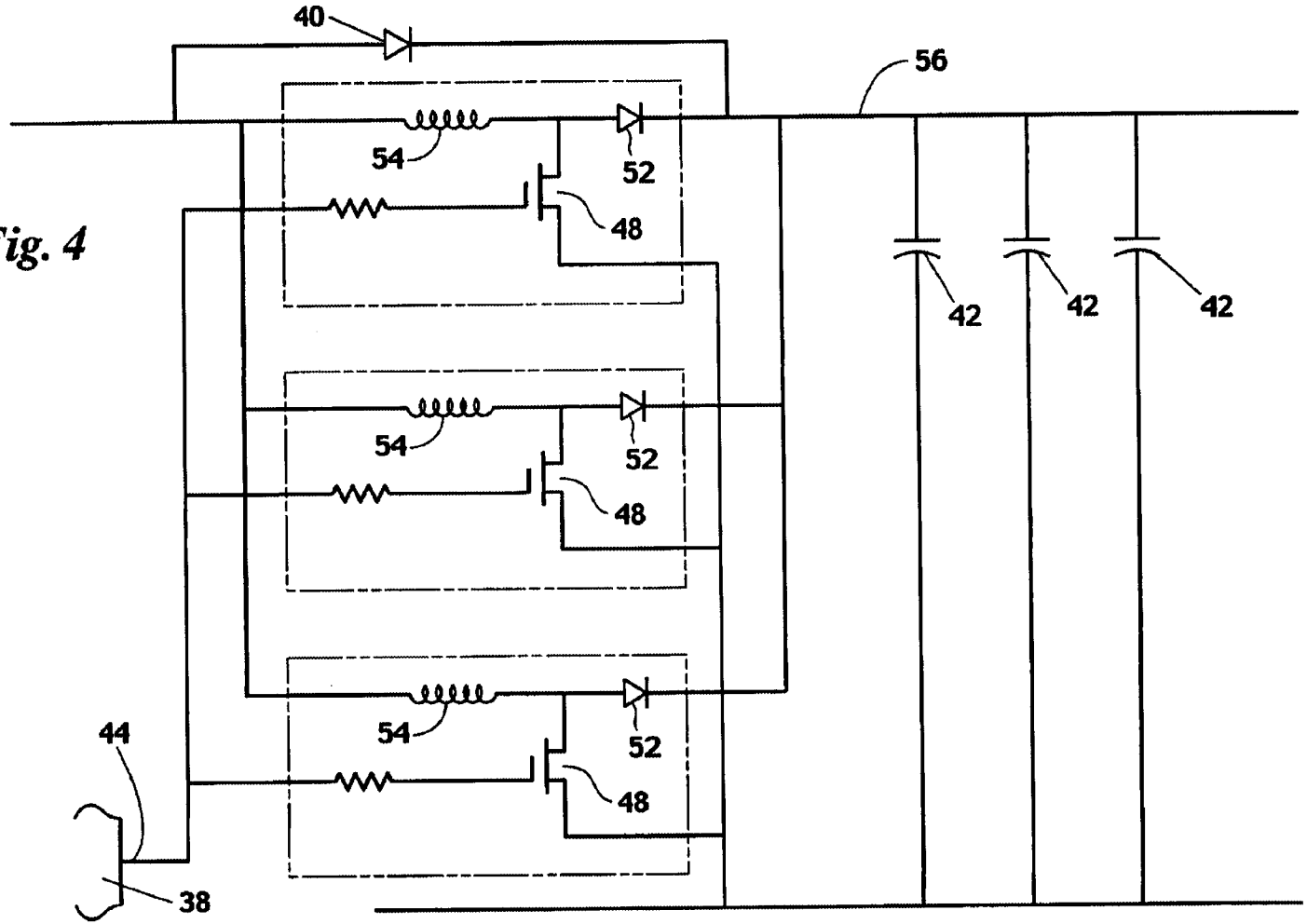
FIG. 4 provides a schematic diagram depicting three power factor correction current paths as incorporated in a 10,000 watt embodiment of the inventive xenon power supply.

For purposes of this invention, "load sharing" refers to the division of electrical current switched among a group of parallel switches. Unfortunately, if multiple switches 48 were simply wired in parallel, variation between individual switches 48 would normally result in large disparities in the current passing through each of the various switches 48 (uneven load sharing). This results in overheating of the device which takes on more than its fair share of the switched load. To avoid this phenomenon, power factor correction circuit 22 preferably includes a separate current path 36 (as shown in FIG. 4) for each switch 48 employed. In this way, each switch 48 switches only the current associated with temporary storage of energy in its associated inductor 54. Diodes 52 provide proper summing of the current from each current path 36 into node 56 as each switch 48 is deactivated. Thus, load sharing is primarily dependant on the consistency between inductors 54 rather than between switches 48.

Figure 5A:
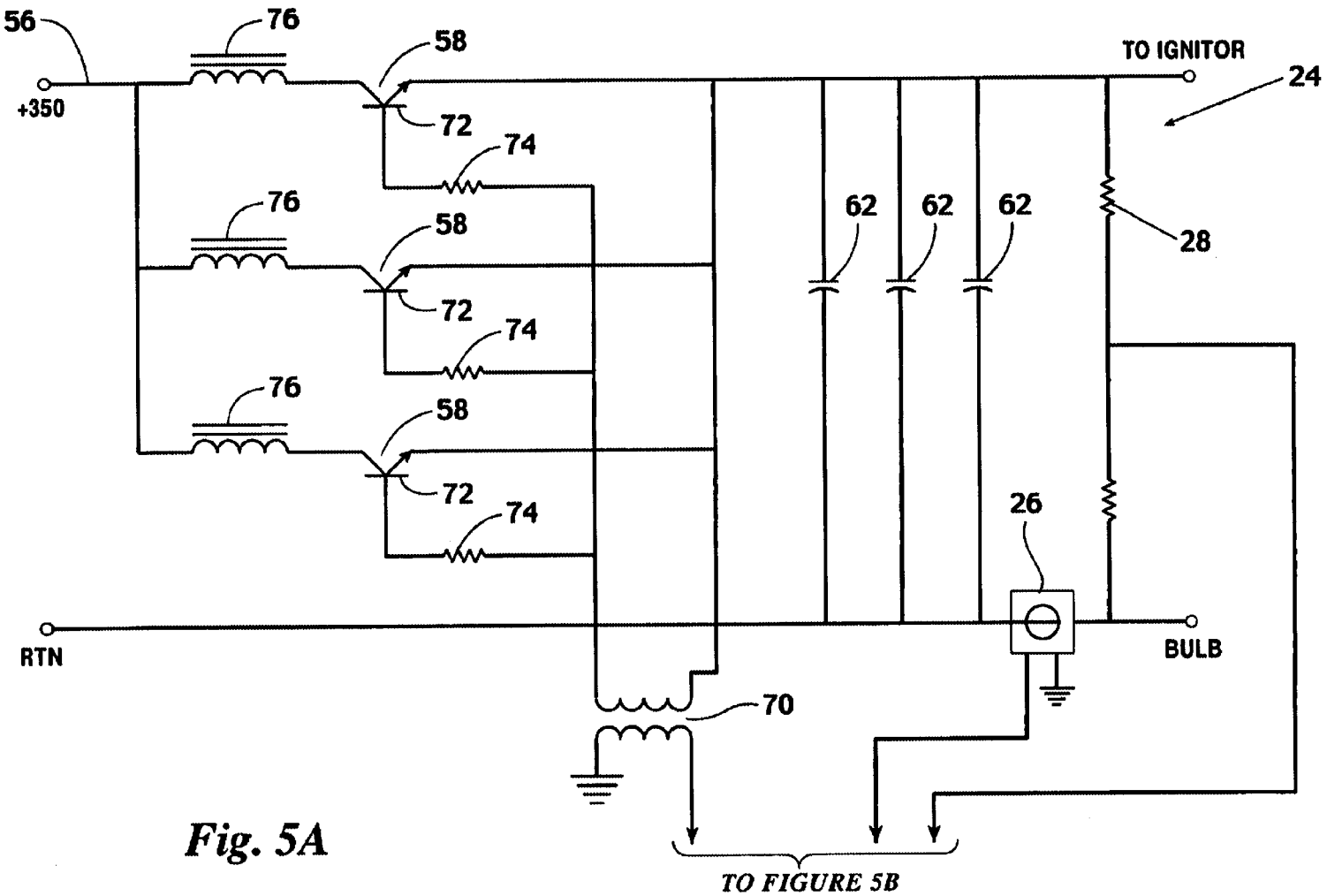
FIGS. 5A and 5B provide a schematic diagram for a preferred second stage regulator circuit as incorporated in the inventive xenon power supply.
Figure 5B:
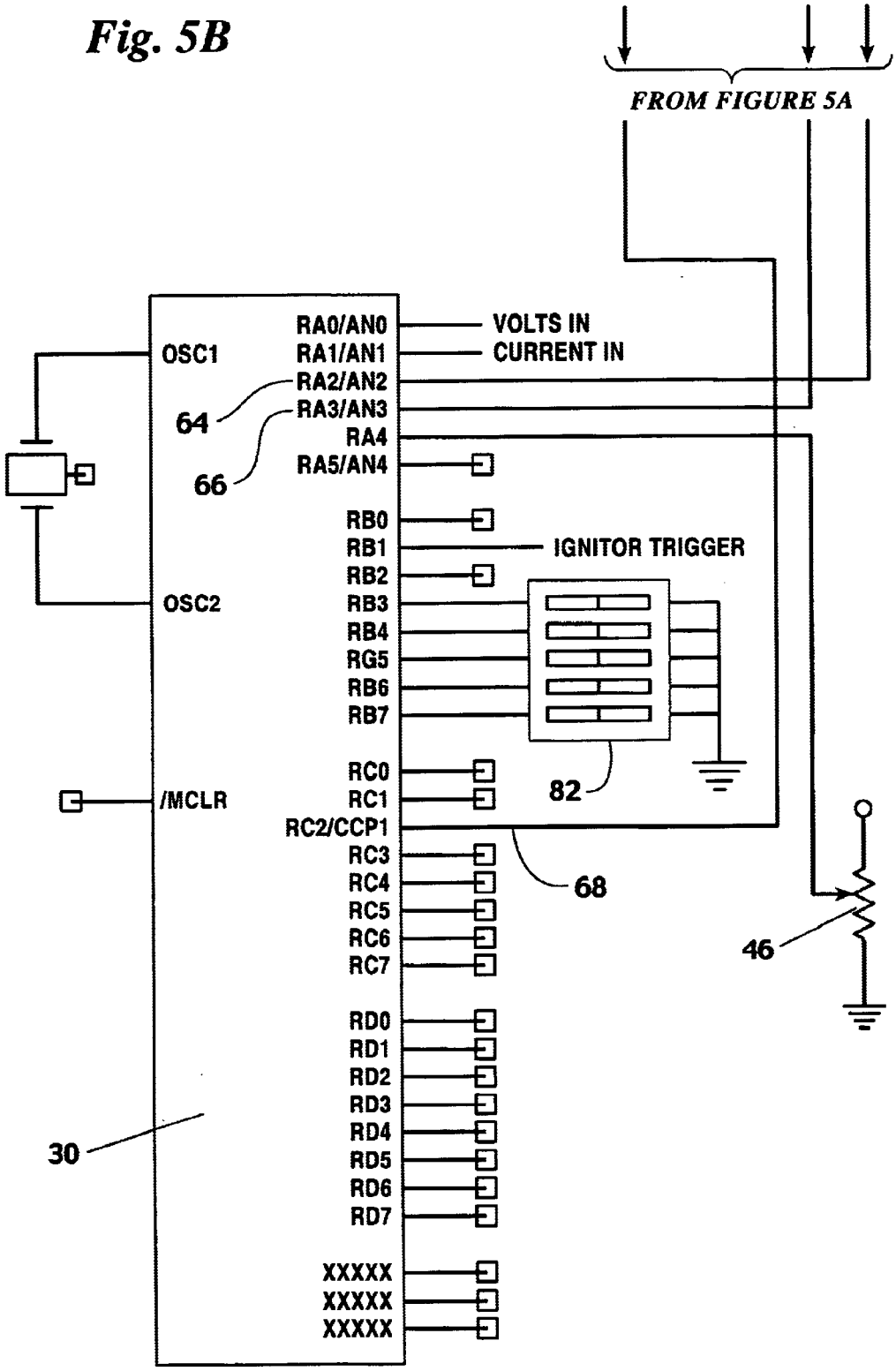

Referring next to FIGS. 5A and 5B, second stage regulator 24 preferably comprises: microcontroller 30; one or more current paths 58; voltage divider 28 providing feedback of the output voltage in a range readable by the microcontroller 30; capacitors 62; and current sensor 26.

Second stage regulator 24 is typically a switching regulator, preferably employing a microcontroller 30 such that regulator 24 can be readily programmed to provide a regulated voltage prior to ignition of the bulb and regulated power after ignition of the bulb. In the preferred embodiment, microcontroller 30 includes first analog input 64 for monitoring the voltage from voltage divider 28 and second analog input 66 for monitoring the output of current sensor 26. Internal to microcontroller 30, inputs 64 and 66 are connected to an analog to digital converter such that microcontroller 30 can determine the analog level of these inputs. In the preferred microcontroller, for example, a voltage between zero and five volts will be converted to a corresponding number between 0 and 1023. A scale factor may be multiplied by the product of the values read from inputs 64 and 66 to calculate the actual power being delivered to bulb 32 (FIG. 1). The duty cycle of the pulse width of modulated output 68 is then adjusted to maintain the desired power level at bulb 32.

In the preferred embodiment, microcontroller 30 is a PIC16F877 manufactured by Microchip Technology, Inc. of Chandler, Az. As will be apparent to those skilled in the art, most manufacturers of microcontrollers offer at least one device which would be suitable for use in the present invention. In addition, the terms "microcontroller" and "microprocessor" are used herein interchangeably to denote a programmable computing device, and the terms refer to any such computing device regardless of the level of integration of the computing device.

Microcontroller 30 includes a programmable pulse width modulator which provides PWM output 68 (shared with I/O pin RC2 in the PIC16F877). The timing of the waveform appearing at output 68 is determined by the values written to internal registers within microcontroller 30. In a regulated voltage mode, i.e. during bulb startup, the microcontroller adjusts the duty cycle of output 68 to maintain the desired voltage at input 64. During the regulated power mode, i.e., during steady-state operation, the microcontroller adjusts the duty cycle based on the actual power being delivered to the bulb as discussed hereinabove.

Continuing with FIGS. 5A and 5B, the pulse width modulator output 68 is connected to one or more solid state switches 72 through a base drive circuit comprising a base drive transformer 70 common to all solid state switches 72 and a resistor 74 connected between the output of transformer 70 and each switch 72. As with the power factor correction circuit 22 (FIG. 2), a solid state switch 72 is preferably a transistor, MOSFET, IGBT, or the like. Unlike the power factor correction circuit, each switch 72 is connected between an inductor 76 and capacitors 62 in a series configuration rather than in a boost configuration as in the power factor correction circuit 22. With regard to the preferred embodiment, it is intended that the voltage produced by the second stage regulator 24 be a fraction of the voltage at node 56 (the input voltage to the second stage regulator 24) rather than producing a voltage greater than the input voltage as does the power factor correction circuit 22. It should be noted, however, that, if the inventive power supply were adapted for use with a long-arc xenon bulb, it might be more appropriate to wire the second stage regulator in a boost configuration, much like the power factor correction circuit.

Again, in reference to solid state switch 72, there exists a tradeoff between operating current and maximum switching speed of the switch 72. As in the case of the power factor correction circuit, individual switches 72 are available which work well at the current requirements for a 4000 watt xenon bulb at the desired frequency (preferably on the order of 100 kilohertz), but such switches are not presently available for bulbs of higher wattage. Thus, the second stage regulator 24 also requires multiple current paths 58. To ensure proper load sharing among the switches 72, each current path includes an inductor 76 which effectively limits the current in each path 58 in light of the switching frequency produced at output 68. Thus, the current flowing through each current path 58, and hence load sharing among the switches 72, is primarily influenced by the inductors 76.

Referring again to FIG. 1, capacitors 42 and 62 filter the outputs of the power factor correction circuit 22 and second stage regulator 24, respectively. Preferably, there is one capacitor for each current path 36 or 58. Since capacitors 36 are connected in parallel and capacitors 58 are connected in parallel, a single capacitor could instead be used on either output. However, by providing a capacitor for each current path, a power supply may be constructed such that, to drive a 4000 watt bulb, a single path 36 and a single path 58 could be employed along with one each of capacitors 42 and 62. Second current paths 36 and 58, and second capacitors 42 and 62 could be added for operation up to 7000 watts. Additional current paths 36 and 58 along with capacitors additional corresponding capacitors 42 and 62 could likewise be added to achieve any level of output power desired. In this way, excess capacitance, which would increase the weight of the power supply, is not unnecessarily included in light of the power of the bulb.

In order to perform the functions required for proper power regulation, microcontroller 30 requires a suitable computer program. A flowchart for the preferred computer program is shown in FIG. 6. Referring also to FIG. 1, initially, at step 200, the program monitors the voltage from voltage divider 80, indicating that power has been applied to the power supply. Upon the detection of electrical power at step 202, the microcontroller 30 (FIG. 5B) monitors the output of input current sensor 14 at step 204. At this point, microcontroller 30 has not yet activated switches 72 (FIG. 5A) and thus, the only input current flowing will be that required for functioning of the power factor correction circuit 22 and to charge capacitors 42. Thus, as capacitors 42 charge, the input current will decrease until the power factor correction circuit 22 reaches its regulated voltage, at which time, the input current will reach a steady-state value.

Upon detecting a steady-state input current indicating that the power factor circuit 22 has achieved regulation at step 206, the microcontroller then begins operation of the pulse width modulator at step 208 and monitors the output voltage at steps 210 and 212.

Upon charging second stage regulator capacitors 62 to a starting voltage (typically about 150 volts), the microcontroller issues an ignitor pulse at step 214. After the ignition pulse, if output current is detected at steps 216 and 218, the bulb has ignited and the program advances to its operational loop at step 220. If no current is detected at step 218, the bulb did not ignite and the microcontroller will repeat the ignition pulse at step 214.

At step 220, the microprocessor reads the output voltage from divider 28 and at step 222 reads the output current from sensor 26. After multiplying the voltage and current at step 224, at step 226 the product is multiplied by a scale factor to calculate actual power output to bulb 32. The desired power is indicated by the selection through jumpers 82 (FIG. 5B) which are read at step 228. The difference between the desired power and the actual output power is then divided by the desired power to yield a percentage error at step 230. At step 232, the duty cycle at output 68 is then adjusted by the same percentage as calculated in step 230. The process then repeats, returning to step 220 to again read the output voltage.

Figure 7:
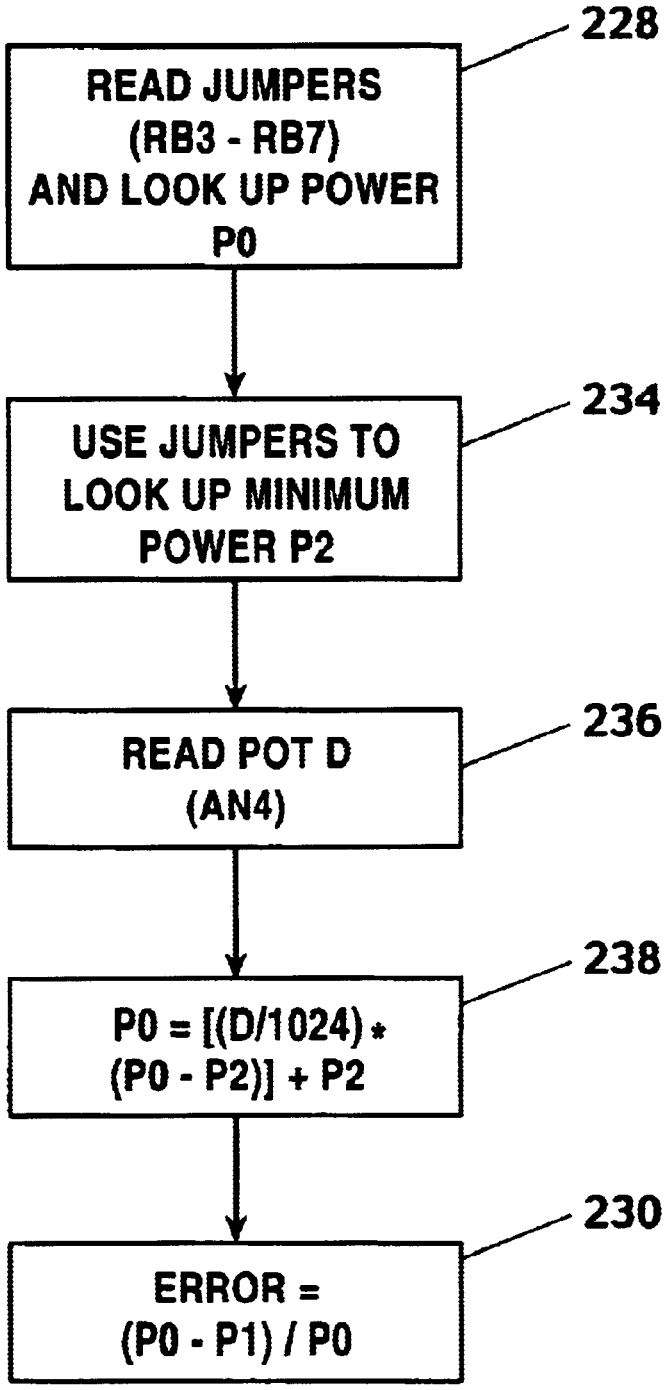
FIG. 7 provides a flow chart of additional computer program steps to include a dimming function in the inventive high power xenon power supply.

In one preferred embodiment, power supply 10 includes a dimming control 46. Referring now to FIG. 7, additional steps are added between steps 228 and 230 of FIG. 6 to add dimming capability to the computer program. In step 234, for the desired power output indicated by jumpers 82, a minimum power output is determined for dimming. The microcontroller next reads the output of potentiometer 46 at step 236 and at step 238 adjusts the desired output power to a given level between the minimum power of step 234 and the maximum power determined in step 228 depending on the value read at step 236. As will be apparent to those skilled in the art, the precise method of inputting the dimming level is unimportant. Dimming values could be provided through analog voltages from another source, a series of switches, a digital interface such as RS-232, DMX-512, or the like and the adjustment of the commanded power output (P0) from any such input is well within the skill level of one of ordinary skill in the art. At step 230, the output power is then adjusted to the result of step 238 rather than the result of step 228.

It should be noted that, if power factor controller 22 includes a synchronizing input (as does the UCC3817), by simply connecting the pulse width modulator output 68 to the synchronizing input (not shown) of power factor controller 38, controller 38 will automatically synchronize its output 44 to that of output 68. This results in switch 48 opening at the same time switch 72 closes such that electrical current flowing through current paths 58 will occur contemporaneously with the flow of current through diodes 52. Managing the electrical current in this fashion reduces the storage requirements of capacitors 42, allowing the use of capacitors having a smaller physical size than would otherwise be possible.

Referring again to FIG. 1, in operation, power applied to connector 12 passes through ground fault interrupter 16 and circuit breaker 18 before rectification by bridge rectifier 20. The ground fault interrupter 16 and circuit breaker 18 protect the power supply 10, up-stream equipment, and the operator from various fault conditions. When power is applied to power supply 10, the power factor correction circuit 22 begins charging capacitors 42 eventually reaching and maintaining a regulated output voltage, preferably around 350 volts DC (most preferably in a range between 150 volts and 550 volts). After the power factor correction circuit has achieved its steady-state voltage, the microcontroller 30 first controls the second stage regulator output 24 in a constant voltage mode at a starting voltage, typically 150 volts. It then produces a high voltage ignition pulses through ignitor 34 until an arc strikes within xenon bulb 32. Microcontroller 30 then changes to a constant power mode wherein microcontroller 30 monitors the output voltage from divider 28 and output current as sensed by current sensor 26 to monitor the output power and modulate output 68 to regulate the power delivered to the bulb at a substantially constant, predetermined value. As will be apparent to those skilled in the art, a power measurement means is necessary to accurately maintain a constant power output. In the preferred embodiment, the microcontroller 30 acting in concert with the current sensor 26 and voltage divider 28 comprise such a power measurement means. However, many techniques are known in the art for measuring the power output of the power supply (i.e., measuring the light output of the bulb) which are suitable for use in the present invention.

As will be apparent to those skilled in the art, while the inventive power supply 10 has been discussed as incorporating a boost regulator 22 for the purposes of power factor correction, followed by a series (or buck) switching regulator 24, the invention is not so limited. By way of example, and not limitation, a single regulator could be employed, powered by simply rectifying and filtering the AC line to eliminate the power factor correction circuit. However, such a modification would likely preclude use of the inventive device in a jurisdiction which has set limits on the power factor of electrical equipment. In another example, as also mentioned above, the second stage regulator could be wired in a boost configuration for use with higher voltage bulbs such as long-arc xenon bulbs. In yet another example, the power factor correction circuitry could be configured to produce a lower voltage than the incoming line voltage. In such a configuration, bypass diode 40 would be undesirable.

It should also be noted that, while all of the switch inputs to current paths 58 are shown wired to a single pulse transformer 70, the switch inputs could instead be wired to separate pulse transformers 70, and the operation of the various switches interleaved. As to capacitors 62, this would effectively triple the frequency of operation (assuming three current paths) and, therefore, allow a reduction in the size of capacitors 62.

As will also be apparent to those skilled in the art, while the preferred embodiment of the inventive power supply is high-power in nature, the invention is not so limited. While prior art power supplies may be more cost effective for lower wattage xenon bulbs in applications where flicker is not an issue, the inventive power supply is, nonetheless, well suited for use with xenon bulbs of virtually any power rating, particularly where constant power output is a consideration.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. A transformerless high power xenon power supply comprising:

a first DC power supply having:

a rectifier, said rectifier having a first input for receiving AC power; a first output; and a first capacitor for filtering the voltage at said first output;

at least a first current path comprising:

a second input for receiving power from said first output;

an inductor;

a controllable switch having a switch input wherein, when said switch input is in a first binary state, said controllable switch is in a conducting state and, when said switch input is in a second binary state, said controllable switch is in a nonconducting state;

a second output for providing power to a xenon bulb; and a second capacitor for filtering the voltage at said second output;

a pulse width modulator having a pulse width modulated output, said pulse width modulated output in communication with said switch input such that, when said pulse width modulated output is in a first binary state, said controllable switch is in said conducting state and, when said pulse width modulated output is in a second binary state, said controllable switch is in said nonconducting state, wherein said second output is not electrically isolated from said first input.

2. The high power xenon power supply of claim 1 wherein, when a xenon bulb is connected to said second output and the waveform at said pulse width modulated output is modulated such that, prior to ignition of the xenon bulb, the electrical power at said second output is regulated at a substantially constant voltage and, after ignition of the xenon bulb, the electrical power at said second output is regulated at a substantially constant power.

3. A transformerless high power xenon power supply comprising:

a first DC power supply having:

a rectifier, said rectifier having a first input for receiving AC power; a first output; and a first capacitor for filtering the voltage at said first output;

at least a first current path comprising:

a second input for receiving power from said first output;

an inductor;

a controllable switch having a switch input;

a second output; and a second capacitor for filtering the voltage at said second output;

a pulse width modulator having a pulse width modulated output, said pulse width modulated output in communication with said switch input such that, when said pulse width modulated output is in a first binary state, said controllable switch is in a conducting state and, when said pulse width modulated output is a second binary state, said controllable switch is in a nonconducting state.

4. A regulator for a high power xenon power supply of the type having a DC power supply which rectifies and filters AC power received from an external source of electrical power and a regulator which receives power from the DC power supply and supplies a xenon bulb with regulated DC power, comprising:

a plurality of current paths, each current path consisting of:

an inductor;

a controllable switch having a switch input such that, when said switch input is in a first binary state, said controllable switch is in conducting state and, when said input is in a second binary state, said controllable switch is in a nonconducting state;

a first output;

a capacitor for filtering the voltage at said first output, a pulse width modulator having a pulse width modulated output, said pulse width modulated output in communication with said switch input such that, when said pulse width modulated output is in a first binary state, said controllable switch is in said conducting state and, when said pulse width modulated output is a second binary state, said controllable switch is in said nonconducting state.

* * * * *